United States Patent [19]

Wesselink et al.

[11] 4,401,914

[45] Aug. 30, 1983

[54] LOW-PRESSURE SODIUM VAPOR DISCHARGE LAMP

[75] Inventors: Gustaaf A. Wesselink; Hendrik Roelofs; Cornelis H. M. Van Bommel, all of Eindhoven, Netherlands

[73] Assignee: U.S. Philips Corporation, New York, N.Y.

[21] Appl. No.: 230,847

[22] Filed: Feb. 2, 1981

Related U.S. Application Data

[63] Continuation of Ser. No. 11,471, Feb. 12, 1979, abandoned.

[30] Foreign Application Priority Data

Feb. 14, 1978 [NL] Netherlands ..... 7801635

[51] Int. Cl.[3] ..... H01J 61/22; H01J 61/34; H01J 61/74; H01J 5/16

[52] U.S. Cl. ..... 313/111; 313/113; 313/116; 313/610

[58] Field of Search ..... 313/25, 204, 227, 220, 313/113, 111, 116

[56] References Cited

U.S. PATENT DOCUMENTS

| | | | |
|---|---|---|---|
| 2,001,501 | 5/1935 | Ruttenauer et al. | 313/204 X |
| 2,194,300 | 3/1940 | Found | 313/25 |
| 2,200,940 | 5/1940 | Uyterhoeven et al. | 313/204 X |
| 2,457,503 | 12/1948 | Singer | 313/485 |
| 3,457,447 | 7/1969 | Menelly et al. | 313/488 X |
| 3,956,656 | 5/1956 | Sprengers | 313/227 X |
| 4,095,135 | 6/1978 | Yamazaki et al. | 313/493 |

FOREIGN PATENT DOCUMENTS

| | | | |
|---|---|---|---|
| 36656 | 6/1955 | Poland | 313/485 |

*Primary Examiner*—Palmer C. Demeo
*Attorney, Agent, or Firm*—Robert S. Smith

[57] ABSTRACT

Low-pressure sodium vapor discharge lamp comprising a hollow inner member surrounded by an outer member, the wall of at least one of the members having grooves and the members of that portion, located between the grooves, extending to or to near the wall of the other member and a discharge space being formed wherein a discharge path, folded by means of the grooves, is present, the portions located between the grooves and facing the wall of the other member and extending to or to near the wall of the other member being provided with intervening portions extending in parallel with that wall.

6 Claims, 4 Drawing Figures

LOW-PRESSURE SODIUM VAPOR DISCHARGE LAMP

This is a continuation, of application Ser. No. 011,471 filed Feb. 12, 1979, now abandoned.

The invention relates to a low-pressure sodium vapour discharge lamp comprising a hollow inner member surrounded by a transparent outer member, the wall of at least one of the members having grooves, the intervening portions of that member located between the grooves, extending to near the wall of the other member, a folded discharge path being formed by means of the grooves which are arranged serially.

Such folding the discharge path can result in a compact lamp. As the dimensions of such lamps can approximately correspond to those of an incandescent lamp, they can be used in many places for general illumination purposes.

German Patent Specification No. 906245 discloses a compact discharge lamp the discharge path of which is lengthened by folding and is located in grooves present in an inner member. The intervening portions, located between the grooves, of the inner member have a somewhat pointed or tapered end near the cylindrical lamp envelope. To prevent the risk of short-circuiting of the discharge, said Patent Specification proposes to provide that portion of the lamp envelope where the tapered portions, located between the grooves, of the inner member are present with bulges or ridges wherein said portions of the inner member are accommodated in a close fit. From a glass-technical point of view such an inner member is not easy to implement owing to the relatively high stresses occurring near the points in the glass. In addition, making the ridges is an additional operation during the manufacture of the lamp wherein the inner member must be positioned accurately into the lamp envelope.

It is an object of the invention to provide a low-pressure sodium vapour discharge lamp which can be produced in a simple manner, which has a high luminous flux per unit of the lamp volume and which is compact.

A low-pressure sodium vapour discharge lamp of the type defined in the preamble is characterized in accordance with the invention in that the intervening portions, located between the grooves and facing the wall of the outer member extend parallel to that wall; leaving a gap with said wall having sufficient width and length to prevent short-circuitry of the discharge.

In general the intervening portions create a narrow, relatively long gap between the two members, whereby a short-circuit or breakdown of the discharge during operation of the lamp can be prevented, so it is not necessary to provide ridges or such like in one of the members (such as the lamp envelope). During production of the lamp the members are slid one into the other and sealed together at one end, for example by means of sealing glass.

Furthermore, the intervening portions have the advantage that the light generated in the grooves and emitted in the direction towards the longitudinal axis of the lamp can leave the lamp unobstructedly through these portions. In addition, extending the discharge path by means of said grooves has the advantage that no additional operations need be performed on glass, as is, for example, the case with a lamp having a multiple folded discharge tube (see Dutch Patent Specification No. 41662). Furthermore, reducing the size of the lamp reduces the cooling surface. Consequently, the required temperature condition of the discharge space can be realised by means of a smaller electric power. A lamp according to the invention, operated by means of d.c. voltage has furthermore the advantage that exhaustion of sodium near the anode, caused by the fact that the (positive) sodium ions moved during operation of the lamp into the direction of the cathode (cataphoresis-effect) is counteracted, owing to transport of sodium through the narrow gap to the region of the anode.

The previously mentioned intervening portions of one member may, if so desired, bear against the wall of the other member. Preferably, however, the gap thickness for example between these portions of the inner member and the opposite portions of the wall of the outer member has a maximum thickness of 2.0 mm. With such a gap spacing the discharge space is closed in a discharge-tight manner, that is to say no discharge breakdown or short-circuiting through the gap can occur during operation of the lamp. Sucha lamp can be produced in a simple manner. In addition "pumping" (evacuation) of the lamp during production proceeds smoothly.

The groove pattern provided on one of the members is decisive of the ultimate shape of the discharge path. In general it is advantageous for the luminous flux and the efficiency of a compact discharge lamp that the discharge path is relatively long. The groove pattern may have been applied in the outer member, the inner member then generally being cylindrical. Preferably, however, the grooves extend in the longitudinal direction of an elongate inner member, the outer member being cylindrical. The lamp is then little vulnerable by fracture.

For a lamp according to the invention the width of the grooves measured along the circumference of the inner member is preferably approximately equal to the width of the intervening portions. This results in a lamp which, during operation, has a uniform appearance and a light distribution which is substantially uniform. The luminous flux per unit of lamp volume is high then.

In another embodiment of the lamp according to the invention a reflecting member is present within the inner member. This reflecting member consists, for example, of a glass tube, coated at the outside with a reflecting layer, such as magnesium oxide. Alternatively, the reflecting member may consist of aluminium. The light distribution of these lamps is very uniform. The luminous flux can be increased and the uniform light distribution of the lamp can be improved by fluting the reflecting member in the direction of the intervening portions. Thus the light emitted into the direction of the longitudinal axis is reflected towards the intervening portions and emerges. The reflecting member may be hollows, so allowing space for an electric stabilisation ballast and/or a starter. In an other embodiment of a lamp according to the invention a uniform light distribution is achieved by providing the intervening portions and/or the portions, located opposite the intervening portions, of the other member with a refraction profile. Lamps according to the invention are particularly suitable for use as a light source for safety illumination, for example on the outside of garages or on factory sites etc.

An embodiment of the invention will be further explained with reference to the accompanying drawings, in which.

Figure 1:
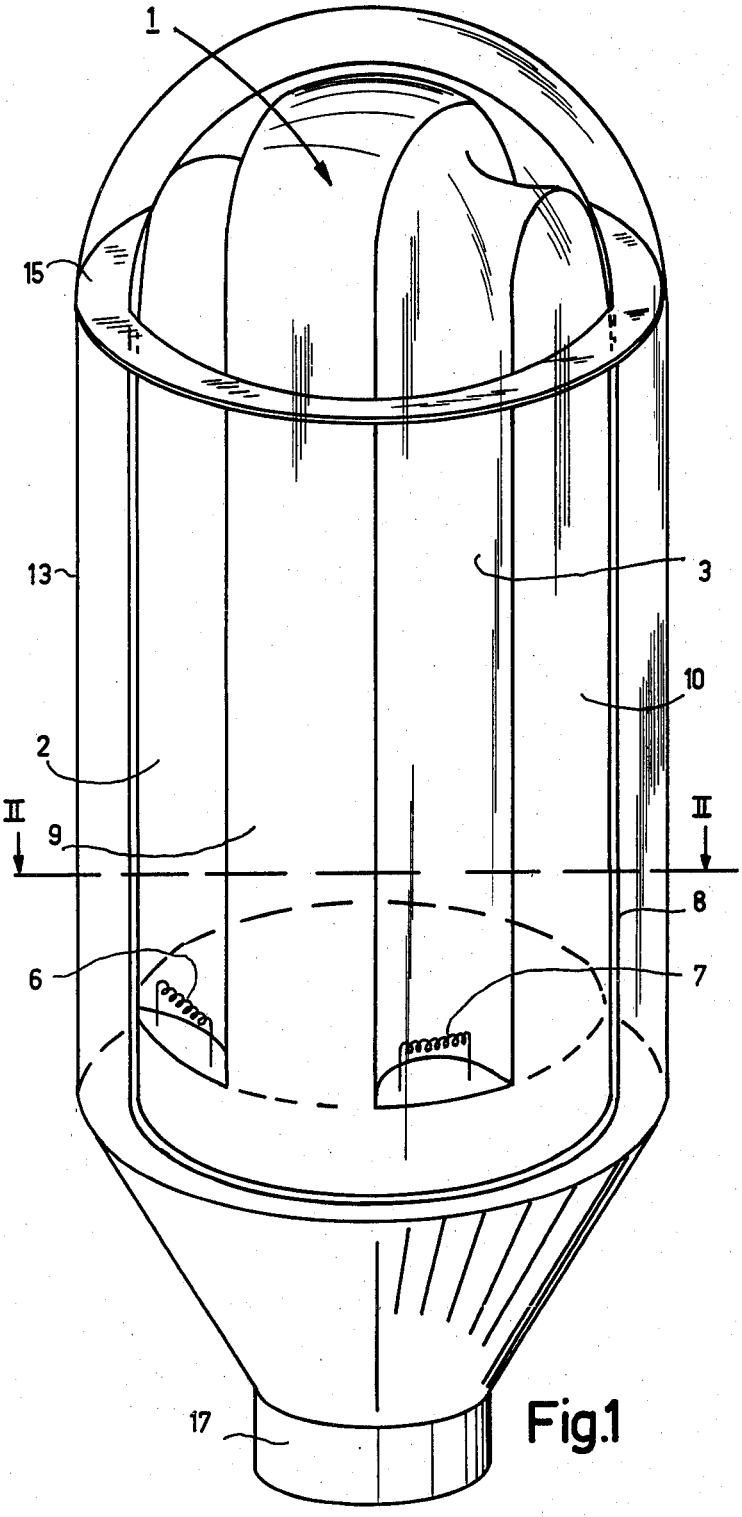
FIG. 1 is a perspective view of a low-pressure sodium vapour discharge lamp according to the invention.

In the Figures reference numeral 1 denotes a hollow inner member of gehlenite glass, which is resistant to the action of sodium vapour. In the longitudinal direction of the inner member there are four grooves 2, 3, 4 and 5 for folding the discharge path between the electrodes 6 and 7. The discharge path travels upwards from electrode 6 through groove 2 and down through groove 4. Thereafter the discharge path extends via a transverse path (represented by a broke line 20 between grooves 4 and 5 and then via groove 5 and groove 3 to electrode 7. The inner member is surrounded by a cylindrical outer member 8.of glass. The intervening portions 9, 10, 11 and 12 of the inner member, located between the grooves, and extending to near the wall of the cylindrical outer member extend parallel to that wall. Gaps having an average thickness of approximately 1.0 mm are present between the portions 10, 11 and 12 and the cylindrical outer member. This spacing is sufficiently small that during operation of the lamp no short circuiting of the discharge occurs via these gaps. The gap thickness between portion 9 and outer member 8 is approximately 0.2 mm. The ends of the inner member and the outer member located near the electrodes are sealed together in a gastight manner by means of sealing glass. In addition, the lamp is provided with a generally cylindrical outer bulb 13. The inner surface of the wall of this outer bulb is provided with an indium oxide layer 14 which is permeable for sodium light but reflects infrared radiation. Numerals 15 and 16 denote an element for locating the outer member 8 relative to the outer bulb 13. The lamp base is indicated by 17. This lamp base accommodates the connecting elements for the electric connection of the lamp.

In a practical embodiment the length of the lamp (the outer bulb included) is approximately 17 cm. The inner diameter of the outer member 8 is approximately 5.5 cm. The inner diameter of the outer bulb is 7 cm. The diameter of the grooves form the discharge path is approximately 1.5 cm. The portions 9 to 12 are approximately 1.5 cm wide. The total length of the discharge path is approximately 50 cm. The lamp contains neon and approximately 30 mg of sodium. With a neon pressure of 6 torr and an applied lamp power of 45 W the efficiency of the lamp was 139 lm/W.

Figure 3:
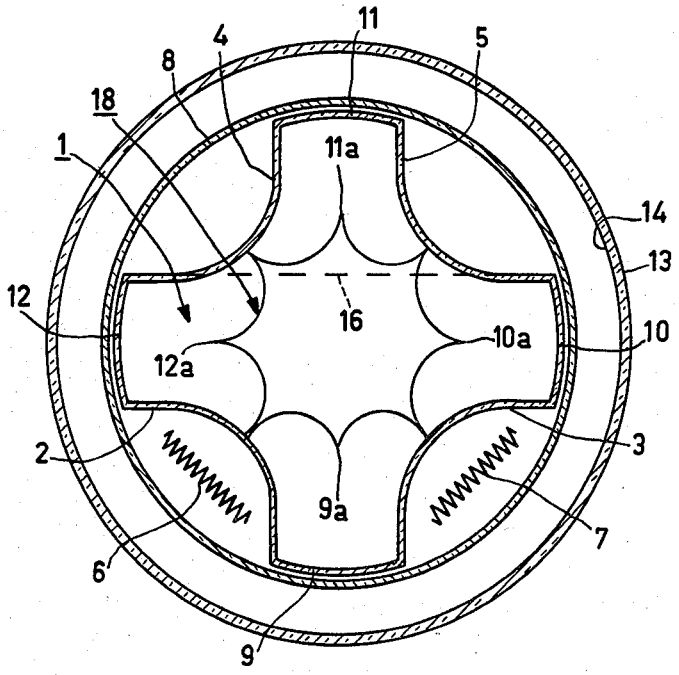
FIG. 3 is a corresponding cross-sectional view of a lamp of FIG. 1, a reflecting member being present within the inner member.

In FIG. 3 a hollow aluminium reflecting member 18 is present in the inner member 1. This member is fluted in the direction of portions (9, 10, 11 and 12) and grooves. This ensures an optimum reflection towards the portions 9 to 12 of the sodium light emitted in the direction towards the lamp axis. The peaks of the flutes of the reflecting member adjacent portions 9 to 12 are denoted by 9*a*, 10*a*, 11*a* and 12*a* respectively. Within the hollow reflecting member there is sufficient room for an electric stabilisation ballast or a starter.

Figure 2:
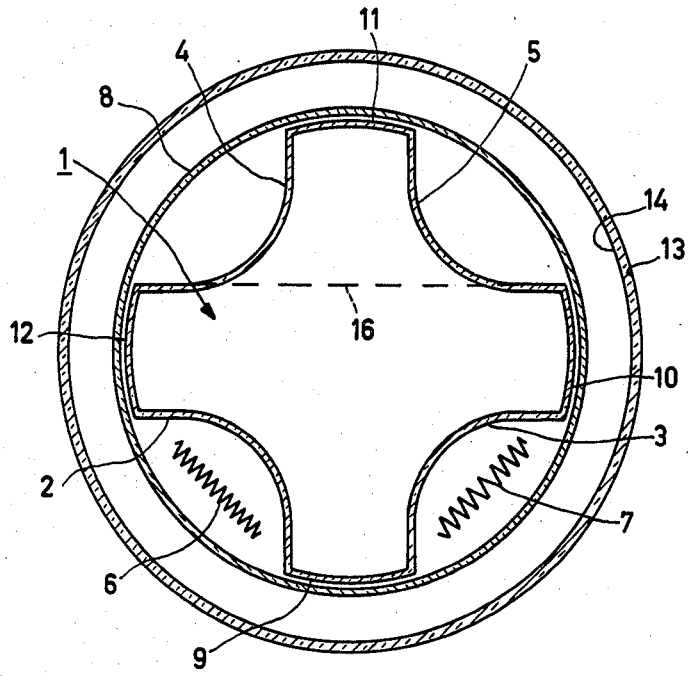
FIG. 2 is a cross-sectional view of a lamp of FIG. 1 along the plane II—II.
Figure 4:
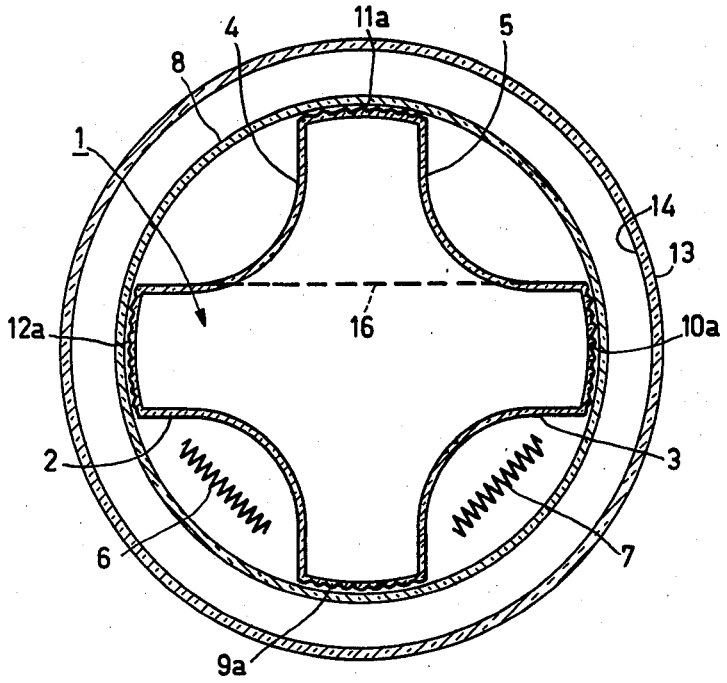
FIG. 4 is a cross-sectional view in accordance with FIG. 2, wherein the intervening portions have been provided with a refraction profile.

FIG. 4 shows a cross-sectional view of a lamp shown in FIGS. 1 and 2, wherein the intervening portions of the inner member have been provided with a corrugated refraction profile (9*a*, 10*a*, 11*a* and 12*a*). The ridges have a prismatic effect causing the light beams coming from the grooves to be refracted, thus producing a uniform light distribution over the lamp surface.

What is claimed is:

1. A low-pressure sodium vapor discharge lamp comprising a hollow inner member surrounded by and nesting with an outer transparent member, a reflecting member being disposed in said inner member, the wall of at least one of the members having one or more grooves and having intervening portions between the grooves which extend near to the wall of the other member; said lamp having a folded discharge space formed by means of said grooves which are arranged serially, said intervening portions located between the grooves facing the wall of the other member extending parallel to that wall and leaving a gap with said wall having sufficient width and length to prevent short-circuitry of the discharge.

2. A low-pressure sodium vapor discharge lamp as claimed in claim 1, characterized in that a gap has a maximum thickness of 2.0 mm between the intervening portions and the opposing portions of the wall of the outer transparent member.

3. A low-pressure sodium vapor discharge lamp as claimed in claim 1 or 2, characterized in that said grooves extend in the axial direction of the inner member and said outer transparent member is cylindrical.

4. A low-pressure sodium vapor discharge lamp as claimed in claim 3, characterized in that, measured along the circumference of the inner member, the width of the grooves is substantially equal to the width of the intervening portions.

5. A low-pressure sodium vapor discharge lamp as claimed in claim 1, characterized in that said reflecting member is fluted and is concave in the direction of at least one of the intervening portions.

6. A low-pressure sodium vapor discharge lamp as claimed in claim 1 characterized in that the intervening portions or the portions, located opposite the intervening portions, of the other member have a refraction profile.

* * * * *